United States Patent [19]

Bederman

[11] 4,148,394

[45] Apr. 10, 1979

[54] BUNDLE OF SELF-SKIDDED MARGACH INGOTS

[76] Inventor: Charles Bederman, 52-12 Leith Pl., Little Neck, N.Y. 11362

[21] Appl. No.: 861,829

[22] Filed: Dec. 19, 1977

Related U.S. Application Data

[63] Continuation-in-part of Ser. No. 709,707, Jul. 29, 1976, abandoned.

[51] Int. Cl.[2] ..... B65D 19/24

[52] U.S. Cl. ..... 206/386; 108/51.1; 108/56.3; 206/597; 206/599

[58] Field of Search ..... 206/386, 597, 599; 108/51.1, 56.3

[56] References Cited

U.S. PATENT DOCUMENTS

| | | | |
|---|---|---|---|
| 3,081,871 | 3/1963 | Fisher et al. | 206/597 |
| 3,498,451 | 3/1970 | Foley et al. | 206/597 |
| 3,570,664 | 3/1971 | Pitts | 206/597 |

*Primary Examiner*—William T. Dixson, Jr.
*Attorney, Agent, or Firm*—Dayton R. Stemple, Jr.

[57] ABSTRACT

A bundle of Margach ingots being self-skidded on platform ingots having legs at each end that provide for insertion of a lift fork between the legs and below the main body of the ingots, said body intermediate its end being weakened at some point for easy breaking into two half ingots, said ends being provided with notches or other means to feed each half ingot on a chain feeder into a molten bath. The bundles must be tied with wire (rather than conventional straps) to fit tightly into the notches on first applying same to avoid later slippage into the notch at a critical time.

7 Claims, 4 Drawing Figures

BUNDLE OF SELF-SKIDDED MARGACH INGOTS

SUMMARY OF INVENTION

This application is a continuation-in-part of my copending application, Ser. No. 709,707, filed July 29, 1976 now abandoned.

This invention relates to new and useful improvements in a bundle of nonferrous metal ingots mounted on platform ingots that serve for palletizing the other ingots of the same alloy thereof, such platform ingots having feeding notches at each end for attachment to chain or other feeding means into automatic feeders and an intermediate weakened area such as a notch intermediate the ends whereby the ingot can be broken into two for feeding purposes by merely striking the ingot against a solid surface such as the floor, all the ingots being tied together by wires encircling the bundle, passing through, and snugly fitting within said end notches.

Prior Art

It is known, of course, to use ingots with legs for forming the base platform for palletizing further ingots as a bundle thereon so that a fork lift truck can be inserted beneath the platform or base for raising the entire bundle. Due to the generally standard size of the forklift, such an ingot must generally be at least about two feet long so as to span the two forks that are normally inserted beneath the base.

Many metal ingots are automatically fed into molten baths and particularly linotype casting machines, zinc dye casting and other similar nonferrous metals by a "Margach" type machine, which has a chain or hook that catches the ingot by a notch or hook at the end which begins to melt as it approaches the molten bath and thus releases the ingot from the chain or other carrier. See, for example, Jung U.S. Pat. Nos. 2,083,913, 2,145,766, 2,157,097 and 2,252,808.

Most of these machines are designed for small ingots and have a weight limit for the ingots that can be fed, for example, in the range of 12 to 15 lbs. However, to produce an ingot long enough to span the double fork of a forklift requires generally a bigger ingot that is apt to weigh from 25 to 30 lbs. with zinc base alloys.

Breaking notches intermediate the ends of ingots are known as shown, for example, in Jung U.S. Pat. Nos. 2,157,097 and Harper 3,352,648.

Ingot bundles are normally tied together as a unit by at least a pair of parallel metal straps surrounding the bundle and wooden pallet.

OBJECTS OF INVENTION

It is an object of this invention to provide a full-sized palletizing-base ingot that can be ultimately fed through automatic equipment such as Margach feeding equipment.

It is a further object of this invention to provide such an ingot with attachment means for the feeding device at each end and with an intermediate weak point so that the ingot may readily be broken and both resultant pieces then fed through the automatic equipment by the attaching means.

It is an additional object of this invention to provide said weakening means with a notch toward the middle of the ingot.

It is also an object of this invention to provide such an ingot with feeding notches at each end for attachment to the feeding chain.

It is another object of this invention to provide a bundle of ingots without wooden or foreign pallets, whereby the platform or base ingots are those just described and the upper or remaining ingots are of normal shape.

It is an added object of the invention to tie said bundle with wire that can be snugly applied within the feeding notches to avoid later slipping.

It is also an object of this invention to provide such an ingot with feeding notches at each end for attachment to the feeding chain.

With these and other objects, the nature of which will be apparent, the invention will be more fully understood by reference to the drawings, the accompanying detailed description and the appended claims.

DESCRIPTION OF THE PREFERRED EMBODIMENT

Figure 1:
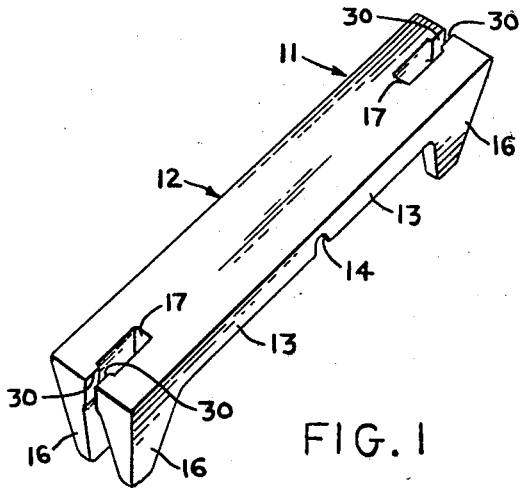
FIG. 1 is a perspective view showing the top and side of an ingot constructed in accordance with this invention.

Referring to the drawings in detail, the invention as illustrated is embodied in ingots disclosing various features of this invention which obviously may be changed within the context of the disclosure and scope of the following claims.

The ingot 11 of this invention is shown in FIG. 1 having a primary base 12 divided into two halves 13,13 by breaking notch 14. At each end are a pair of legs 16,16 between the bases of which is a feeding notch 17 restricted somewhat by ears 30,30.

Figure 2:
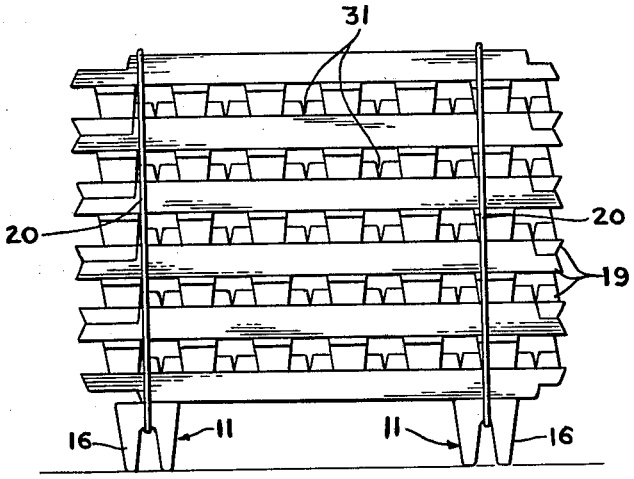
FIG. 2 is a side view of a palletized bundle of conventional Margach ingots on a pair of the platform ingots of FIG. 1, said bundle being secured with wires.
Figure 3:
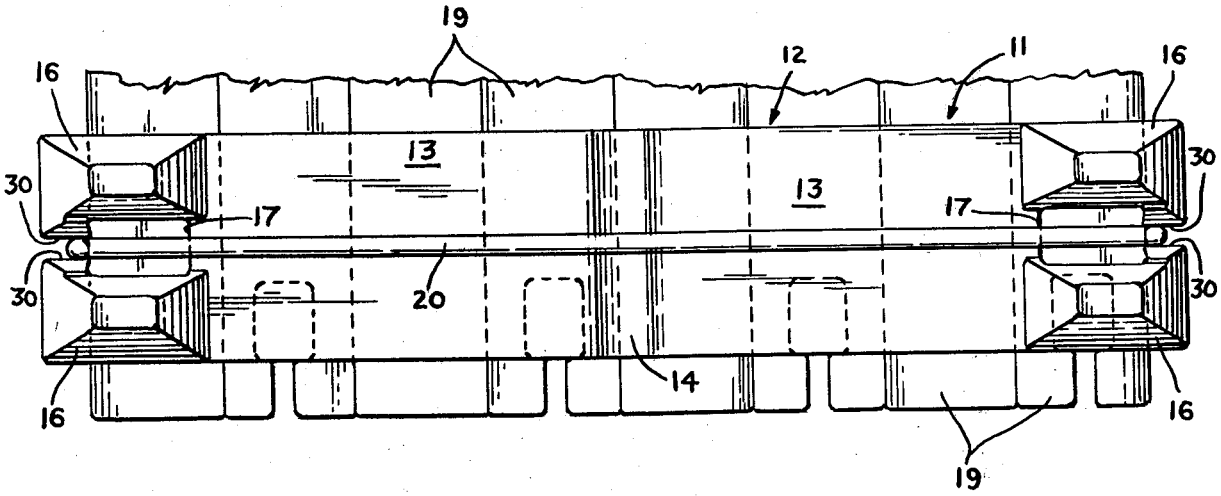
FIG. 3 is a partial bottom plan view of the bundle of FIG. 2 showing one platform ingot and the securing wire.
Figure 4:
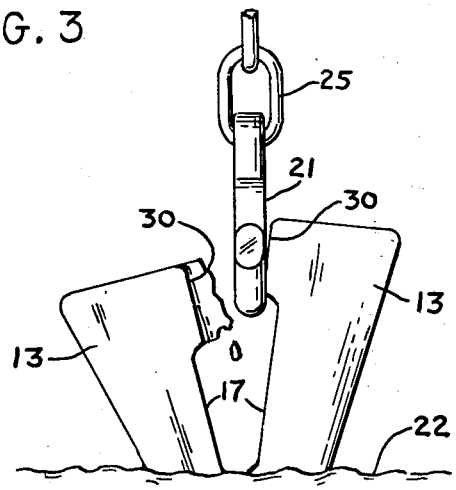
FIG. 4 is a perspective view of a half-ingot of FIG. 1 as it is being fed into the molten bath.

As shown in FIG. 2, a palletized bundle of ingots are supported on a bottom base pair of ingots 11,11 as just described. The legs 16 are as small as possible to permit a wider span for reception of fork lift prongs (not shown). The remaining upper layers are regular Margach ingots 19 with a notch 31 at one end for feeding purposes. The first layer of regular ingots must be transverse to the platform ingots. After the first layer, it is preferable to have each layer transverse to the prior layer to give greater stability to a higher bundle.

Wires 20,20 passing through the notches 17 of the leg ingots maintain the ingots in position on the pallet. Normally ingot bundles are tied with metal strapping but it was found unworkable because the straps might or might not pass between the ears 30 of the feeding notches 17. It was found necessary to use wire for tieing the bundles as the wire on initial application to the bundle will pass between the ears until it rests against the associated regular ingot 19 to form a taut line when secured. Thereafter, there will not be slippage into the notches (which occurs with strapping) at a critical time of transporting which can cause the bundle to fall apart and possibly injure workers.

$\frac{1}{4}''$ steel strap tends to pass each through the ears 30 but breaks quite often. $2\frac{1}{2}''$ strap passes the ears only occasionally at application but may pass later. It has been found desirable to use galvanized steel wire from about 8 (0.165") to 12 (0.109") B.&S. gauge. The wire size should be such that it will readily pass between ears 30 when being applied to the bundle of ingots, 10 (0.134) gauge being preferred. Aluminum and copper wire are available but break easily and are more expensive.

This permits stacking of the ingots at the foundry where formed, handling by lift truck during movement there and on to the truck or railroad car for shipment to ultimate destination and subsequent handling with lift truck to unload and to utilize the ingots at the ultimate destination without wasting a pallet or being forced to return same to the shipper, as the entire palletized pile will be utilized for final melting and casting.

At the casting plant, once the top regular ingots 19 have been used, the leg ingots 11 will be reached and an operator will pick up same at one end, tap it on the floor, and break it into two pieces by reason of breaking notch 14. Thereafter, feeding notch 17 will be placed on the hook 21 attached to feeding chain 25. Ears 30 help maintain the hook 21 in position which will carry the half ingot 13 into the molten bath 22. As the half ingot passes through the molten bath and the notch 17 approaches the bath, the ingot will begin to soften about the notch so that the gravity will pull the ingot off the hook and it will fall completely into the molten bath in a manner well known with Margach feeding machinery.

I claim:

1. A platform ingot comprising an elongated body, a pair of spaced legs extending downwardly from each end of said body, said body having a length between said leg pairs sufficient to permit entry of a forklift beneath said body, a breaking notch in said body intermediate said ends, and an attaching notch at each said end in the space between the associated legs extending between the top and bottom body surfaces, said notch having a restricted opening at the body end and being wider inwardly of the opening, said notch permitting attachment to a continuous chain feed mechanism.

2. The ingot of claim 1 wherein said breaking notch is located near the mid-point between said ends.

3. A bundle of ingots comprising a pair of parallel spaced platform ingots of claim 1, a first row of non platform ingots mounted on and transverse to said platform ingots, additional rows of non platform ingots stacked above said first row of ingots, and a pair of parallel wires stretched taut and secured about all of said ingots, each wire describing a plane through the associated attaching notches at each end of a different one of said platform ingots, said non platform ingots having no legs and being of substantially uniform thickness throughout their length except at the ends.

4. The bundle of claim 3 wherein each row of non platform ingots is stacked transverse to adjacent rows.

5. The bundle of claim 4 wherein said wire is galvanized steel of about 0.109 to 0.165 inches diameter.

6. The bundle of claim 5 wherein said wire is about 0.134 inches diameter.

7. The bundle of claim 3 wherein said non platform ingots are Margash ingots.

* * * * *